US011786084B2

(12) United States Patent
Abbosh et al.

(10) Patent No.: US 11,786,084 B2
(45) Date of Patent: Oct. 17, 2023

(54) METHOD AND APPARATUS FOR FOLDING AND OPENING-UP WIPES

(71) Applicant: Better All Round Limited, London (GB)

(72) Inventors: Oday Abbosh, London (GB); Philip Russell Fawcus, Cambridge (GB); Julian Brandon-Jones, Whittlesford (GB); Emanuel Nannizzi, Lucca (IT); Gianluca Giometti, Lucca (IT); Dave Reed, Bury St Edmunds (GB)

(73) Assignee: Better All Around Limited, London (GB)

( * ) Notice: Subject to any disclaimer, the term of this patent is extended or adjusted under 35 U.S.C. 154(b) by 114 days.

(21) Appl. No.: 17/211,311

(22) Filed: Mar. 24, 2021

(65) Prior Publication Data

US 2021/0204763 A1 Jul. 8, 2021

Related U.S. Application Data

(62) Division of application No. 15/536,154, filed as application No. PCT/GB2015/054057 on Dec. 17, 2015, now Pat. No. 10,973,375.

(30) Foreign Application Priority Data

Dec. 18, 2014 (GB) ..... 1422632

(51) Int. Cl.
*B31D 1/04* (2006.01)
*B31D 5/00* (2017.01)
(Continued)

(52) U.S. Cl.
CPC ..... *A47K 10/16* (2013.01); *B31D 1/04* (2013.01); *B31D 5/0086* (2013.01);
(Continued)

(58) Field of Classification Search
CPC ..... A47K 10/16; A47K 10/34; B31F 1/0009; B31F 1/00; B31D 5/0086; B31D 1/04;
(Continued)

(56) References Cited

U.S. PATENT DOCUMENTS 1,015,085 A * 1/1912 Salstrom ..... B65D 3/06 248/188.8
1,829,833 A * 11/1931 Kast ..... B65H 5/307 270/52.29

(Continued)

FOREIGN PATENT DOCUMENTS

WO WO2014029775 A1 2/2014

*Primary Examiner* — Thomas M Wittenschlaeger
*Assistant Examiner* — Katie L Gerth

(57) ABSTRACT

Apparatus is provided for manufacturing a wipe in a three-dimensional form out of an essentially flat piece of material. The apparatus produces a blank of essentially flat planar form with a pleat folded on each side. The folded blanks are fed by a conveyor belt to an opening station. The opening station comprises a pair of movable pinch rollers which selectively grab individual blanks from the conveyor belt and feed them via belts to a pair of counter-rotating drums. The blanks are ejected from the drums, which partially opens them up in the process. The partially open blanks are fed onto a shaped former, where the final process of forming the wipe into its chosen three-dimensional form is completed.

9 Claims, 2 Drawing Sheets

Figure 1:
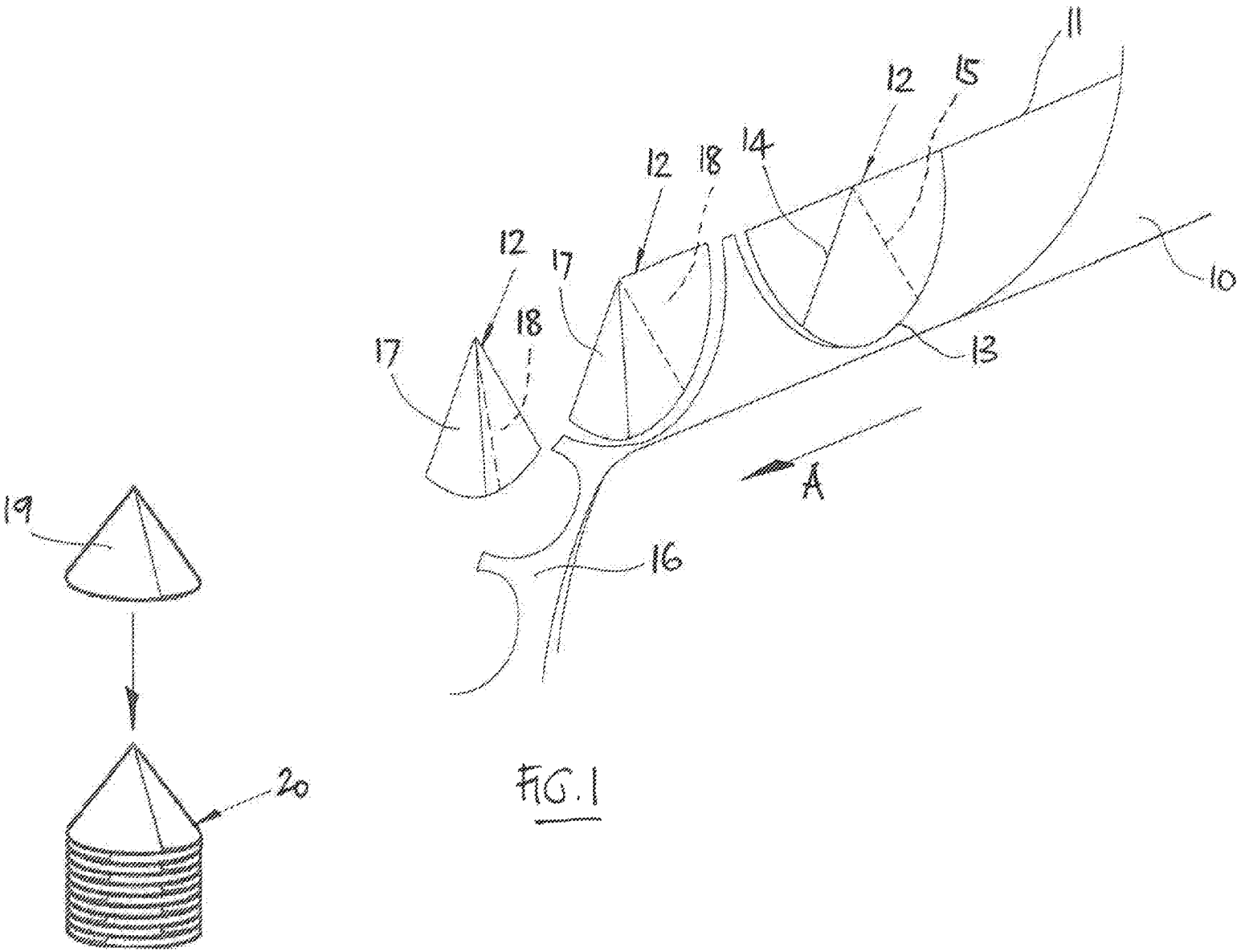

(51) Int. Cl.
*B31F 1/00* (2006.01)
*B31B 50/10* (2017.01)
*B31B 50/12* (2017.01)
*A47K 10/16* (2006.01)

(52) U.S. Cl.
CPC ..... *B31F 1/0009* (2013.01); *B31B 50/102* (2017.08); *B31B 50/12* (2017.08); *B65H 2301/323* (2013.01); *B65H 2301/4474* (2013.01); *B65H 2301/44734* (2013.01); *B65H 2404/2614* (2013.01); *B65H 2406/323* (2013.01); *B65H 2701/11238* (2013.01); *B65H 2701/1924* (2013.01)

(58) Field of Classification Search
CPC ..... B31D 5/00–04; B31D 5/0082; B65H 2701/11238; B65H 2406/323; B65H 2404/2614; B65H 2301/4474; B65H 2301/44734; B65H 2301/323; B65H 2701/1924; B65H 45/12; B65H 39/02; B65H 5/307; A47G 19/03
USPC ..... 493/423
See application file for complete search history.

(56) References Cited

U.S. PATENT DOCUMENTS 1,997,368 A * 4/1935 Kleinschmit ..... B65H 5/222 270/52.24
2,171,484 A * 8/1939 Squire ..... B01D 39/18 210/497.2
2,349,115 A * 5/1944 Sanford ..... B01D 29/085 210/497.2
2,552,474 A * 5/1951 Amberg ..... B65D 3/06 225/74
2,563,633 A * 8/1951 Amberg ..... B31B 50/00 493/154
3,087,721 A * 4/1963 McCain ..... B65H 5/307 270/52.29
3,248,102 A * 4/1966 Couzens ..... B65H 39/16 221/48
3,412,994 A * 11/1968 Dutro ..... B65H 5/307 270/52.28
3,543,980 A * 12/1970 Brockmuller ..... B65B 41/06 225/96
3,567,033 A * 3/1971 Whelan ..... B01D 29/085 D7/400
3,800,954 A * 4/1974 Lampcov ..... A47J 31/08 210/497.2
4,265,437 A * 5/1981 Reist ..... B65H 45/12 493/435
4,706,950 A * 11/1987 Ruetschle ..... B65H 5/12 270/52.28
4,976,420 A * 12/1990 Flensburg ..... B65H 5/32 271/100
5,045,039 A * 9/1991 Bay ..... B65H 15/004 493/1
5,082,256 A * 1/1992 Bryson ..... B65H 1/28 270/52.2
5,356,128 A * 10/1994 Eberle ..... B65H 29/003 271/204
5,462,266 A * 10/1995 Meier ..... B65H 5/12 271/204
5,595,379 A * 1/1997 Hoang ..... B65H 39/02 270/52.29
5,653,671 A * 8/1997 Reuteler ..... B65H 1/24 53/381.1
5,779,232 A * 7/1998 Ochsner ..... B65H 45/12 270/45
5,810,345 A * 9/1998 Lehmann ..... B65H 39/06 270/52.26
8,201,387 B2 * 6/2012 Passoni ..... B65H 3/10 53/381.5
D747,236 S * 1/2016 Abbosh ..... D11/142
D764,968 S * 8/2016 Abbosh ..... D11/142
2003/0121236 A1 * 7/2003 Middelberg ..... B65H 39/02 53/569
2004/0048727 A1 * 3/2004 Roozrokh ..... B65H 45/12 493/424
2006/0122574 A1 * 6/2006 Gooding, Jr. ..... B65H 45/16 604/385.02
2006/0273099 A1 * 12/2006 Abbosh ..... A47K 10/16 221/33
2008/0176729 A1 * 7/2008 Anelli ..... B65H 45/28 493/360
2008/0187733 A1 * 8/2008 Abbosh ..... B32B 29/005 428/218
2008/0210703 A1 * 9/2008 Abbosh ..... B65D 83/0894 221/45
2009/0243179 A1 * 10/2009 Bader ..... B65H 39/02 270/58.03
2010/0167893 A1 * 7/2010 Wilkerson ..... B31B 70/00 493/227
2011/0290618 A1 * 12/2011 Stauber ..... B65H 29/003 198/470.1
2012/0157288 A1 * 6/2012 Coenen ..... B65H 45/12 493/435
2014/0274637 A1 * 9/2014 Ballestrazzi ..... B65B 9/06 493/243

* cited by examiner

METHOD AND APPARATUS FOR FOLDING AND OPENING-UP WIPES

CROSS REFERENCE

The present invention claims benefit of U.S. application Ser. No. 15/536,154 filed Jun. 15, 2017.

DESCRIPTION

This invention relates to wipes.

The term "wipes" is used herein to refer to the kinds of disposable absorbent products known variously as tissues, cloths, paper towels, kitchen roll and the like, which may be made of paper, cloth or any other suitable material or combination of materials and which may be moist, wet or dry and which may be embossed, perforated, quilted or printed or have any other surface decoration or treatment and which may be otherwise treated, e.g. by impregnation with perfume, lotions and/or disinfectant.

The invention provides a method of producing wipes in a three-dimensional form from an essentially flat piece of material, including putting at least two creases in the piece of material, folding the piece of material about these creases to create a blank of essentially planar form, and opening out said blank into a three-dimensional form.

The invention also provides apparatus for manufacturing a wipe in a three-dimensional form out of an essentially flat piece of material, said apparatus including means for putting at least two creases in the piece of material, means for folding the piece of material about these creases to create a blank of essentially planar form, and opening out the blank into a three-dimensional form.

Figure 2:
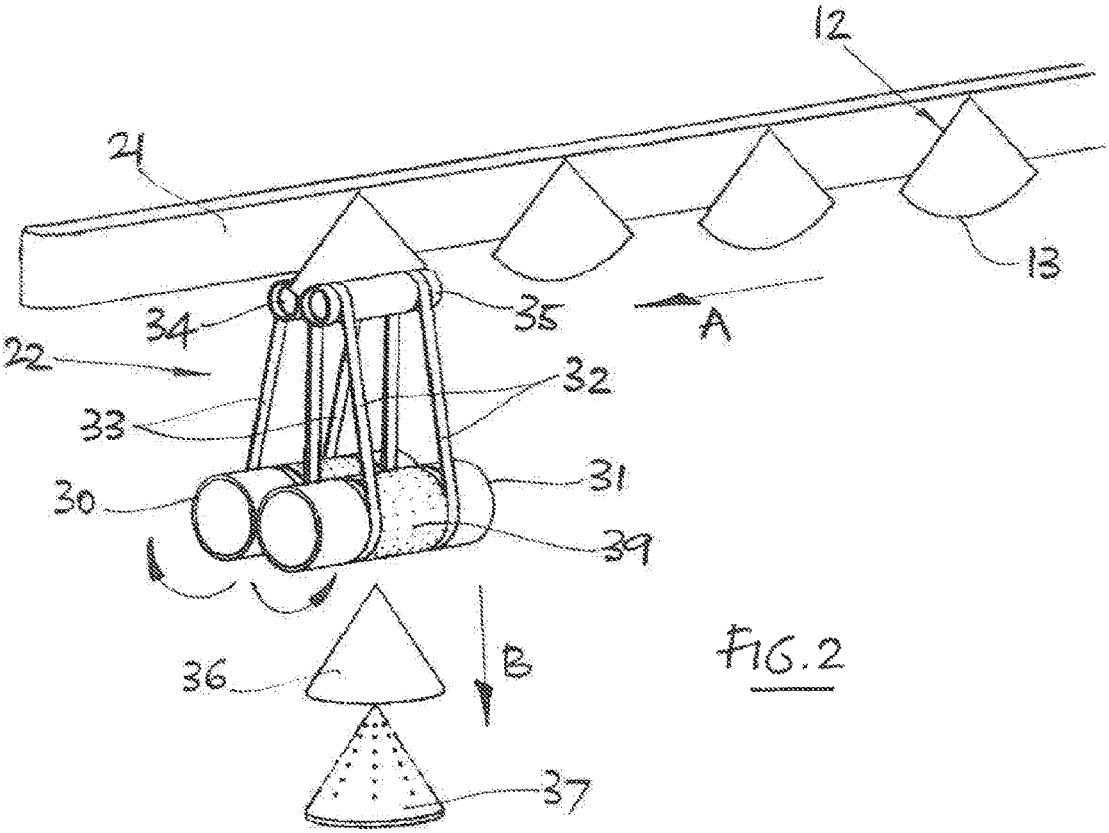
Figure 3A:
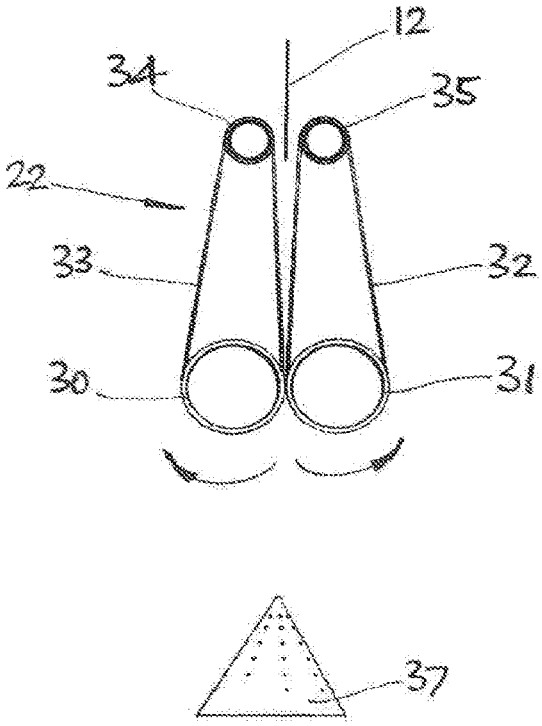
Figure 3B:
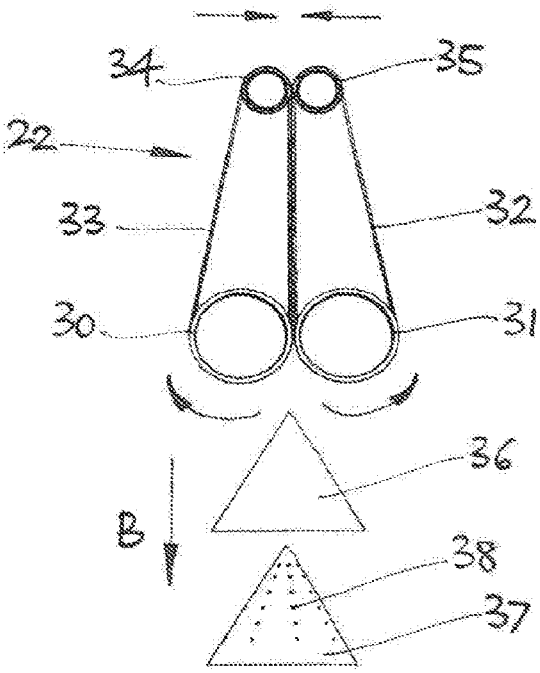

By way of example, embodiments of the invention will now be described with reference to the accompanying drawings, in which:

FIG. 1 is a schematic illustration of a method of producing wipes in accordance with the invention, FIG. 2 shows a station for forming blanks into three dimensional wipes, and FIGS. 3*a* and 3*b* illustrate operation of the wipe forming station of FIG. 2.

It is proposed to produce wipes having a three-dimensional shape, starting from a piece of substantially flat material. The formed wipes are to be collated and packaged together in their three-dimensional shape in the form of a nested stack. A suitably shaped dispenser is used to contain the stack with the upper most wipe ready to be taken for use.

The preferred three-dimensional shape for the wipes is conical, with the dispenser holding the stack in use with the apex of the wipes extending upwardly.

In a preferred method according to the invention, as seen in FIG. 1, the wipe production process starts with a continuous elongate web of material 10. The web 10 is fed, e.g., from a roll, onto a production line in the direction of arrow A. In a first operation, a first folding station acts to fold the web 10 in half along its longitudinal centreline. This produces a doubled-over web 10 with a folded edge 11.

The next operation involves a cutting and creasing station to cut a blank 12 out of the folded web 10 and put creases 14, 15 into it. This can conveniently be achieved in a single operation, e.g., by means of counter-rotating drums and a fly cutter. The cutting and creasing station cuts the blank 12 in a semi-circular shape, with its straight side being the folded edge 11 of the web 10 and its curved side forming free edges 13. The unwanted remainder 16 of the web 10 is conveniently fed away for re-cycling.

The creases 14, 15 are arranged to be formed in the blank 12 from opposite sides (in FIG. 1, crease 14 is formed from the visible side of the blank 12, whereas crease 15 is formed from the opposite, unseen side). The purpose of the creases 14, 15 is to facilitate folding of the blank 12, and they are formed from opposite sides because the blank will be folded from opposite sides, as will be described later.

As seen in FIG. 1, the creases 14, 15 both extend radially from the mid-point of the folded edge 11 to the free edges 13 of the blank 12. The creases 14, 15 are arranged symmetrically on the blank 12 and in this case, they each subtend an angle of approximately 45° with respect to the folded edge 11. This produces a desired three-dimensional form for the finished wipe having a cone angle of around 60°. It will of course be understood that the arrangement of the creases may be varied in order to produce a different cone angle.

The next operation involves a second folding station in which the blank 12 is folded about its creases 14, 15 to create two pleats 17, 18. As noted above, the folding operation forms one of the pleats 17, 18 on one side of the blank 12 and the other pleat on the other side. The second folding station can conveniently use counter-rotating drums, with an air blade picking up the blank 12 by a leading edge (with respect to the direction of arrow A) in order to fold it about crease 14 to form the pleat 17. A counter-rotating bail arm can be used to pick up the blank 12 by a trailing edge (with respect to the direction of arrow A) in order to fold it about crease 15 to form pleat 18.

The blank 12 leaves the second folding station in substantially flat planar form, but now twice folded with pleats 17, 18 on either side. The blanks 12 then undergo further operations where they are opened out into the three-dimensional form of the finished wipe 19, which in this case is conical, with the wipes then being collated to form a stack 20.

FIG. 2 shows an opening station 22 for transforming the blanks 12 from their substantially flat planar folded form into the three-dimensional form of the finished wipe. The blanks 12 are conveniently conveyed to the opening station 22 by a conveyor belt 21 with vacuum suction pressure. As will be seen in FIG. 2, the blanks 12 are arranged to be held by the conveyor belt 21 with their free edges 13 hanging clear below it. This enables the blanks 12 to be picked up by the mechanism of the opening station 22.

The mechanism of the opening station 22 comprises a pair of counter-rotating drums 30, 31 arranged with their rotational axes parallel. Each of the drums 30, 31 is connected via a pair of belts 32, 33 to a respective pinch roller 34, 35. The pinch rollers 34, 35 are also arranged with their rotational axes parallel. The belts 32, 33 are conveniently trained about the drums 30, 31 and rollers 34, 35 in grooves so as to lie essentially flush with the cylindrical outer surfaces. The cylindrical surfaces of the drums 30, 31 and/or rollers 34, 35 and/or belts 32, 33 are preferably textured and/or of suitably chosen materials in order to be able to provide sufficient grip for maneuvering the blank 12.

As a further aid to maneuvering the blank, the drums 30, 31 are conveniently perforated with a series of holes 39. This allows the possibility of introducing air pressure at the cylindrical surface of each drum 30, 31. In this case, vacuum suction pressure is used, and this is preferably able to be applied selectively at particular stages in the rotational movement of the drums 30, 31.

The pinch rollers 34, 35 are mounted so as to be movable towards and away from each other. The purpose of this is to enable individual blanks 12 to be picked from the conveyor belt selectively. The operation of the pinch rollers 34, 35 is seen in FIGS. 3*a* and 3*b*.

FIG. 3*a* shows the pinch rollers 34, 35 in their open position. In this position, it will be seen that the blanks 12 are free to pass between the pinch rollers 34, 35 without interference. It will be noted that this arrangement allows the possibility for the conveyor belt 21 to be used to feed blanks 12 to a plurality of opening stations in a production line.

FIG. 3*b* shows the pinch rollers 34, 35 in their closed position. In this position, the blank has been caught between the pinch rollers 34, 35 and fed via moving belts 32, 33 to the counter-rotating drums 30, 31. The blank has then been ejected from the nip between the drums 30, 31 in the direction of arrow B.

It will be noted that the blank is oriented with its free edges 13 leading, with respect to the direction of arrow B. This means that when the blank emerges from the nip between the drums 30, 31, there will be a tendency for it to open out as its free edges 13 catch the air, in a manner similar to the opening of a parachute. The frictional forces acting on the blank from the drums 30, 31 and belts 32, 33 will tend to assist with this opening out process, as will the selectively applied suction pressure. Further assistance may be provided, if necessary, for example by training a jet of air on the free edges 13 of the blank in a direction opposite to arrow B. From its emergence from the nip between the drums 30, 31, the now partially opened blank 36 is thrown onto a conically shaped former 37.

The partially opened blank 36 preferably goes fully onto the former 37, so that it will accurately take up the desired conical form of the finished wipe. This process may be assisted, for example by the use of vacuum suction pressure acting through holes 38 in the former 37. Other measures, such as electrostatic charge, might also be used in the process. The finished form of the wipe may be further perfected by tamping the blank in position on the former 37.

The former 37 may conveniently be one of a plurality of similar formers that are mounted on a movable carriage, e.g., in the form of a rotatable carousel. This allows the possibility for blanks to be fed to successive formers in turn as the carriage is indexed forward. Finished wipes can then be fed from the formers into tubes to form stacks.

The invention claimed is:

1. An apparatus for manufacturing a wipe in a three-dimensional conical form out of an essentially flat piece of material, said apparatus including:

means for folding a continuous web of material to form a folded continuous web of material, means for cutting a folded blank from the folded continuous web of material and putting at least two creases in the folded blank from opposite sides, means for folding the folded blank from opposite sides about these creases to create a pleated blank of planar form, and means for opening out the pleated blank into the three-dimensional conical form, wherein the means for opening out the pleated blank into the three-dimensional conical form comprises a pair of counter-rotating drums between which the pleated blank is fed to impart an impetus to the blank, and wherein the pair of counter-rotating drums are perforated with a plurality of holes and are operable to introduce vacuum suction pressure and/or air pressure during the step of opening out the blank.

2. The apparatus as claimed in claim 1, wherein said means for imparting an impetus to the pleated blank is arranged to do so in the plane of its planar form.

3. The apparatus as claimed in claim 1, wherein the pleated blank is provided with free, unfolded edges and the impetus that is imparted to the pleated blank is applied with the free edges leading.

4. The apparatus as claimed in claim 1, wherein the means for opening out the pleated blank further comprises means for selecting individual blanks from a moving line of blanks.

5. The apparatus as claimed in claim 4, wherein said blank selecting means operates at right angles to the direction of movement of the line of blanks.

6. The apparatus as claimed in claim 4, wherein said blank selecting means comprises a pair of openable and closable pinch rollers.

7. The apparatus as claimed in claim 1, further comprising a conically shaped former for setting the blank in the three-dimensional conical form.

8. The apparatus as claimed in claim 7, further comprising means for deploying vacuum and/or air pressure to assist with holding the blank on the former and/or ejecting the blank from the former.

9. An apparatus for manufacturing a wipe in a three-dimensional conical form out of an essentially flat piece of material, said apparatus including:

means for folding the essentially flat piece of material, means for cutting a folded blank from the folded essentially flat piece of material, means for putting at least two creases in the folded blank from opposite sides, means for folding the folded blank from opposite sides about these creases to create a blank of essentially planar form, and means for opening out the pleated blank into the three-dimensional conical form.

* * * * *